United States Patent [19]

Camm et al.

[11] Patent Number: 4,937,490

[45] Date of Patent: Jun. 26, 1990

[54] HIGH INTENSITY RADIATION APPARATUS AND FLUID RECIRCULATING SYSTEM THEREFOR

[75] Inventors: David M. Camm; Arne Kjørvel, both of Vancouver; Anthony J. Housden, North Vancouver; Nicholas P. Halpin, Vancouver; Dean A. Parfeniuk, Vancouver; Andy J. Frenz, Vancouver, all of Canada

[73] Assignee: Vortek Industries Ltd., Vancouver, Canada

[21] Appl. No.: 286,127

[22] Filed: Dec. 19, 1988

[51] Int. Cl.[5] ..... H01J 61/52

[52] U.S. Cl. ..... 313/12; 313/35; 313/231.41; 313/231.51; 313/321.71

[58] Field of Search ..... 313/12, 22, 24, 35, 313/44, 231.41, 231.51, 231.71

[56] References Cited

U.S. PATENT DOCUMENTS

| | | | |
|---|---|---|---|
| 3,292,028 | 12/1966 | Van Ornum | 313/30 |
| 3,366,815 | 1/1986 | Anderson | 313/32 |
| 3,405,305 | 10/1968 | Winzeler et al. | 313/231 |
| 4,027,185 | 5/1977 | Nodwell et al. | 313/35 |
| 4,700,102 | 10/1987 | Camm et al. | 313/24 |

*Primary Examiner*—Donald J. Yusko
*Assistant Examiner*—Michael Horabik
*Attorney, Agent, or Firm*—Shlesinger & Myers

[57] ABSTRACT

An apparatus for producing high intensity radiation has electrodes positioned within an elongated cylindrical arc chamber across which an arc discharge can be established. Liquid is injected into the arc chamber to produce a vortex motion therein to form a cylindrical liquid wall adjacent to the chamber, which constricts the arc by cooling an outer periphery thereof. Gas is injected into the arc chamber to produce a vortex motion adjacent the cylindrical liquid wall. An exhaust structure actively exhausts the liquid and gas from the arc chamber to reduce turbulence and restriction of fluid. This permits attainment of higher flux densities in the arc, and/or extension of electrode life. Preferably, the liquid and gas are exhausted actively by means of an ejector pump which ejects pressurized liquid into the gas and liquid leaving the arc chamber. The ejector pump pressurizes the exhausted gas and liquid sufficiently to permit the gas to be separated and recycled back to the arc chamber, without requiring an additional compressor to increase gas pressure.

20 Claims, 3 Drawing Sheets

HIGH INTENSITY RADIATION APPARATUS AND FLUID RECIRCULATING SYSTEM THEREFOR

BACKGROUND OF THE INVENTION

The invention relates to a high intensity radiation apparatus, and to fluid recirculating systems associated therewith.

U.S. Pat. Nos. 4,027,185 (Nodwell et al) and 4,700,102 (Camm et al) disclose high intensity radiation apparatus of a type generally similar to the present invention. Each patent discloses an elongated cylindrical arc chamber fitted with coaxial, longitudinally separated electrodes positioned within the chamber. Gas and liquid injected at the inlet of the chamber generate a vortexing motion so that a liquid wall is formed adjacent the arc chamber which cools the arc periphery and increases electrode life.

In the above patents, and in all similar devices known to the inventors, residual momentum and gravity move the liquid and gas from the arc chamber into a receiving tank or sump, in which the liquid and gas are separated for further re-use by ancilliary equipment, such as fluid pumps and compressors. This ancilliary equipment accounts for a major portion of the capital cost of the apparatus, and furthermore requires the most maintenance. Also, relying on momentum and gravity to remove fluid from the arc chamber has been found to reduce potential efficiency of the apparatus, and also impose limitations upon installation of the apparatus as follows.

Fluid turbulence and flow restriction at the outlet of the chamber tend to consume excess power, and also to increase risk of liquid splashes reaching an adjacent electrode, which reduces life of the electrode. Furthermore, pressure of the gas and liquid dumped into a sump was not recovered in the prior art apparatus, thus contributing to operating energy requirements.

Dumping of liquid from the arc chamber under gravity, as used in the prior art apparatus, requires that the sump be positioned below and close by the arc chamber. This imposes severe limitations on installation of the arc chamber with respect to other portions of the apparatus.

SUMMARY OF THE INVENTION

The invention reduces the difficulties and the disadvantages of the prior art by providing a high intensity radiation apparatus in which fluid restriction adjacent to the outlet of the arc chamber is reduced which improves fluid flow characteristics and reduces energy requirements. Furthermore, the number of components is reduced, which reduces capital cost. Also, relative positions of the arc chamber and sump can be varied considerably when compared with the prior art.

An apparatus according to the invention is for producing high intensitY radiation and comprises an elongated cylindrical arc chamber and first and second electrode means positioned co-axially within said chamber between which an arc discharge can be established. The apparatus also includes liquid injecting means, gas injecting means and exhausting means. The liquid injecting means is for injecting liquid into the arc chamber to produce a vortex motion therein to form a cylindrical liquid wall adjacent the chamber. This is to constrict the arc discharge by cooling an outer periphery of the arc discharge. The gas injecting means is for injecting gas into the arc chamber to produce a vortex motion therein adjacent the cylindrical liquid wall. The liquid and gas pass through the arc chamber and the exhausting means actively exhausts the liquid and gas from the arc chamber, thus reducing flow restriction adjacent an outlet of the chamber.

A method according to the invention utilizes apparatus generally similar to the above and is characterized by injecting a liquid and a gas into the arc chamber and generating a vortex motion therein. In this way, the liquid forms a cylindrical liquid wall adjacent the chamber, and the gas follows a vortex motion adjacent the cylindrical liquid wall. The liquid and gas are actively exhausted from the arc chamber while maintaining an arc between the electrodes.

Actively exhausting the liquid and gas from the chamber reduces chances of liquid splashes reaching the electrode which increases electrode life. Furthermore, actively exhausting the liquid and gas increases the pressure of the liquid and the gas leaving the outlet of the chamber to an extent sufficient to permit the gas to be recycled back to the inlet of the chamber, without requiring an additional gas compressor as in the prior art. This simplifies ancillary apparatus associated with the invention by eliminating the need for a separate gas compressor which decreases capital cost and maintenance costs. Elimination of some ancillary equipment also reduces the number of moving parts, which decreases gas losses as well as energy consumption.

A detailed disclosure following, relating to drawings, describes a preferred apparatus and method of the invention which is capable of expression in apparatus and method other than those particularly described and illustrated.

DETAILED DISCLOSURE

Figure 1A:
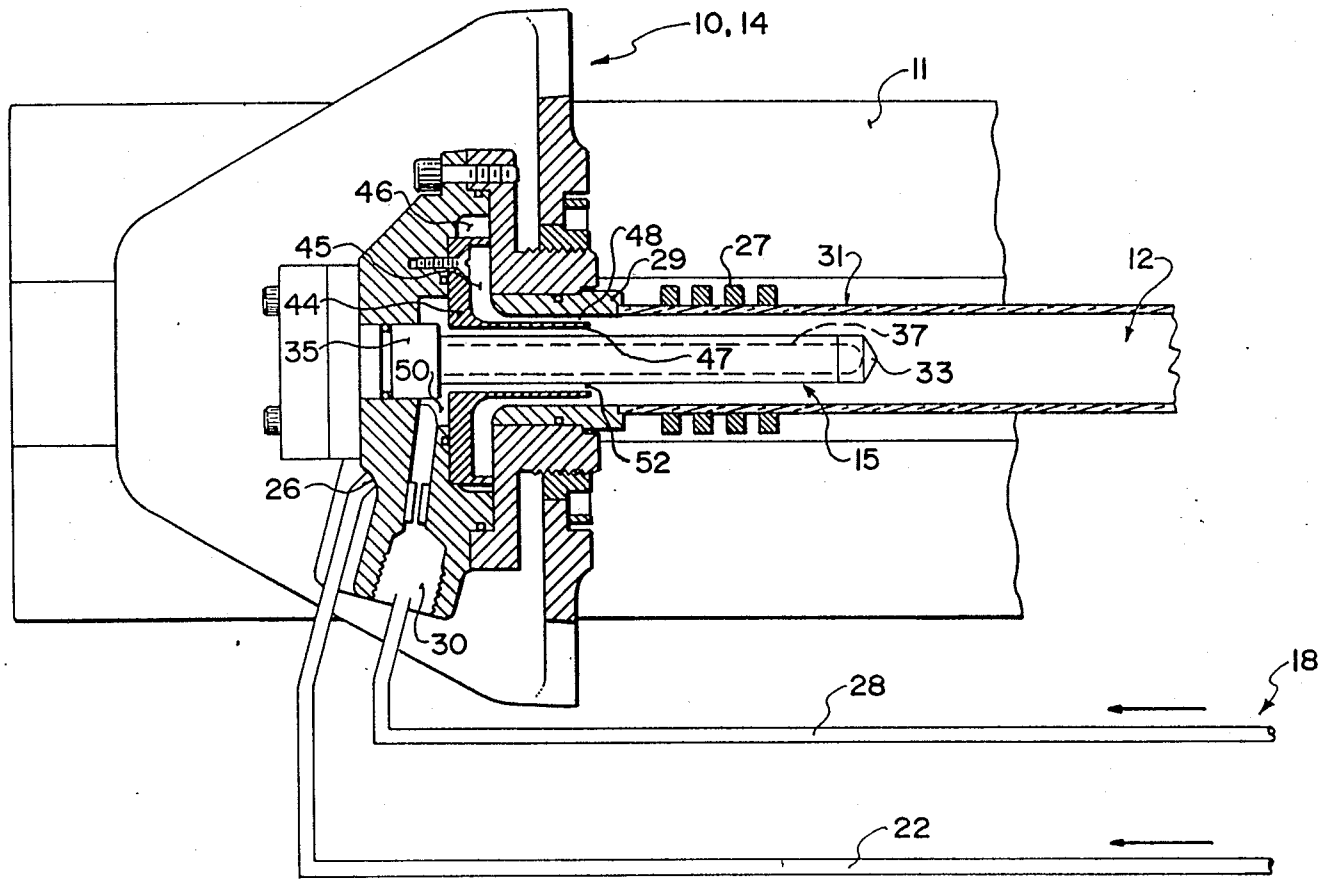
FIG. 1A is a simplified fragmented longitudinal cross-section on a diameter of one portion of an apparatus according to the invention, some portions being shown diagrammatically or omitted for clarity.
Figure 1B:
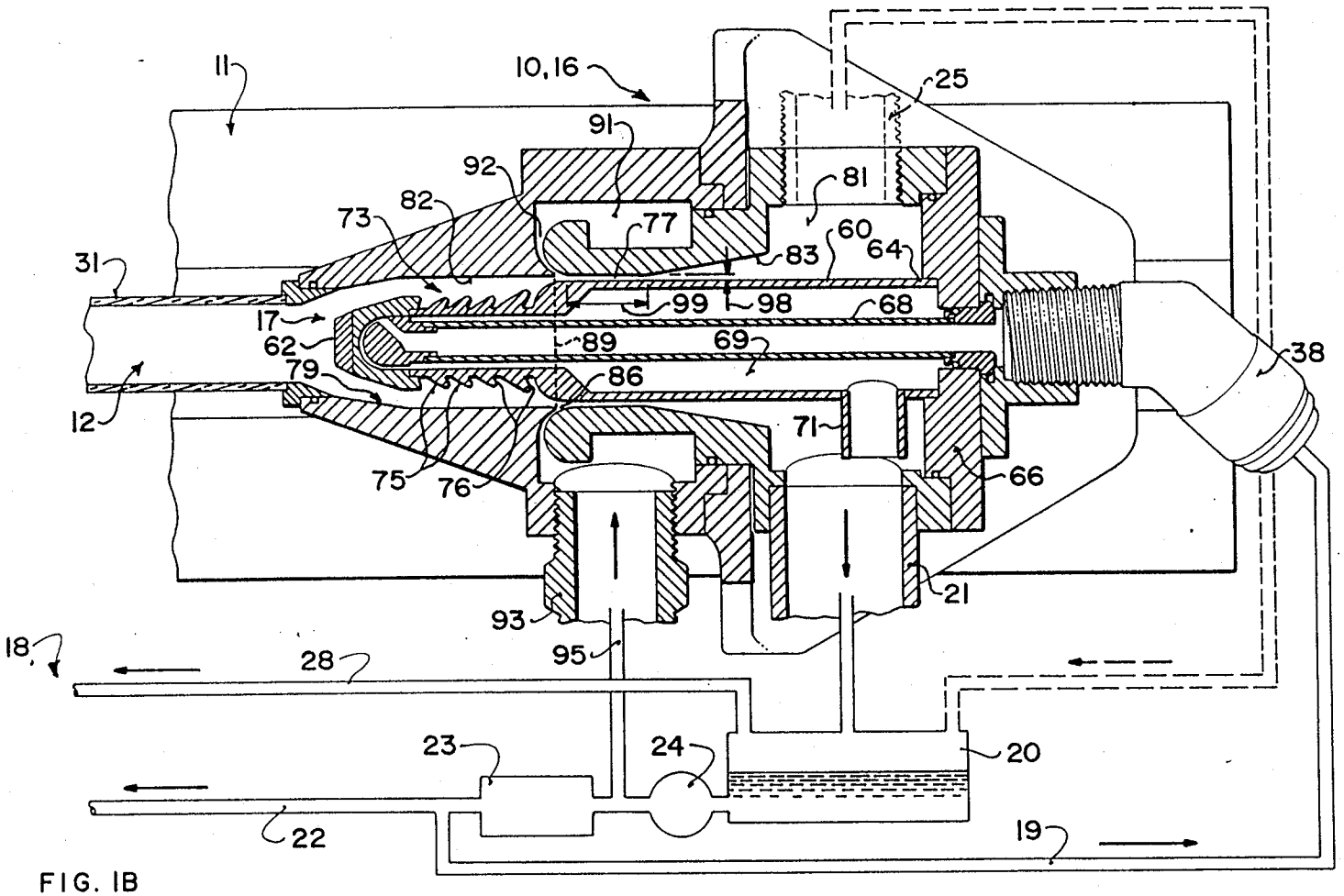
FIG. 1B is a simplified fragmented longitudinal cross-section on a diameter of a remaining portion of the apparatus shown in FIG. 1A, some portions being shown diagrammatically or omitted for clarity.

FIGS. 1A and 1B

A high intensity radiation apparatus 10 comprises a mounting 11, a quartz cylindrical arc chamber 12, an inlet or cathode housing 14 generally having a first electrode 15, and an outlet or anode housing 16 generally having a second electrode 17. Thus, it can be seen that the apparatus has first and second electrode means positioned coaxially within the arc chamber between which an arc discharge can be established as is known in the art. Ancillary electrical apparatus, such as a starting circuit and power supply circuit, is provided to initiate and maintain an arc discharge between the cathode and anode until sufficient current is provided to maintain the arc. Such equipment is well known and described in the said U.S. Pat. No. 4,027,185, and the disclosure of major portions of that patent relating to this equipment is hereby incorporated by reference. The apparatus also requires ancillary fluid supply equipment for passing a cooling liquid and an inert gas, e.g. water and argon respectively, through the arc chamber. This equipment includes a fluid recirculating system 18 having a sump 20 to receive the fluid, i.e. gas and liquid, discharged from the anode housing through a downwardly extending fluid discharge conduit 21. A liquid recirculating pump 24 pumps liquid from the sump back to the apparatus, some of the liquid first passing through a heat exchanger 23 to cool the liquid. A liquid return line 22 extends from the heat exchanger to a cooling liquid inlet 26 in the cathode housing 14. A similar liquid return line 19 extends from the heat exchanger 23 to a cooling liquid inlet 38 in the anode housing 16.

A gas return line 28 extends from an upper portion of the sump 20 to a gas inlet 30 in the cathode housing 14. In the prior art, a separate gas compressor to recirculate the gas through the line 28 would be required, but in the present invention the separate prior art gas compressor is eliminated. Instead, in the invention residual pressure from a secondary pump, which exhausts the liquid and gas from the arc chamber, is used to return gas to the cathode, as will be described.

Alternatively, as shown in broken outline, a gas discharge conduit 25 can extend upwardly from the anode housing 16 for separate removal of gas from the anode housing. In this alternative, mostly gas would be discharged through the upwardly extending conduit 25 to be returned to the sump 20. In either case, the gas would be recirculated to the cathode housing through the gas return line 28.

The arc chamber 12 comprises a cylindrical arc tube 31 of suitable transparent material, e.g. quartz, which is supported at opposite ends in the cathode and anode housings 14 and 16 respectively. An annular tube support 29 is carried in the cathode housing 14 and supports the adjacent end of the arc tube 31. A plurality of spark arresters 27 extend peripherally around an end of the tube 31 adjacent the cathode housing 14 as is known.

Referring to FIG. 1A, the cathode housing 14 of the present invention is generally functionally similar to that of U.S. Pat. No. 4,700,102, and includes the electrode 15 having an electrode tip 33 and a root portion 35 secured in the housing 14. A cooling water pipe 37, shown in broken line, extends from adjacent the root portion 35 towards the tip 33, and receives cooling water through a cooling water delivery conduit, not shown. Water returns from the tip, along the outside of the tube 37 to discharge from the cathode housing 14 through an electrode cooling water outlet and conduit, not shown, to the sump 20.

The housing 14 also includes a vortex generating chamber 45 which has an inlet 46 for receiving cooling water from the cooling water inlet 26. A flanged pipe 44 forms one wall of the vortex generating chamber 45, and has a tube portion 47 which is disposed radially inwardly of the tube 29 supporting the arc tube 31. The tube portion 47 also encloses a portion of the electrode 15, and it can be seen that space between the tubes 29 and 47 forms an outer annular duct 48 which serves as an outlet for the vortex generating chamber 45. Details of the means to generate the vortex are shown in U.S. Pat. No. 4,700,102, the disclosure of which is incorporated by reference herein. The outer duct 48 discharges the liquid from the chamber 45 as a rotating liquid vortex which passes along the inside wall of the arc chamber 12 towards the anode housing. Thus, the cathode housing 14 has liquid injecting means for injecting liquid into the arc chamber 12 through the duct 48 to produce a vortex motion therein to form a cylindrical liquid wall adjacent the chamber. This is used to constrict the arc discharge by cooling an outer periphery of the arc discharge, as in the previously referred to patents.

Gas from the gas inlet 30 is injected tangentially into a gas cavity 50 and discharges outwardly through an inner annular duct 52 extending between the electrode 15 and the tube 47. The gas thus exits from the inner annular duct 52 in a vortex which is preferably in the same direction as the water discharged into the arc chamber through the outer annular duct 48. Thus, the cathode housing has gas injecting means for injecting gas into the arc chamber to produce a vortex motion therein adjacent the cylindrical liquid wall. The liquid and gas pass through the arc chamber between the electrode housings as described in the said U.S. Pat. No. 4,700,102.

Referring to FIG. 1B, the second electrode 17 of the anode housing 16 has a sidewall 60, an electrode tip 62 adjacent an outer portion of the electrode, and a root portion 64 extending from a mounting which serves as an outer wall 66 of the anode housing. An annular exit duct 77 is defined by a portion of the side wall 60 of the electrode, and an inner wall 79 of the anode housing 16. The exit duct 77 extends between an end of the arc chamber 12 adjacent the anode housing 16, and a low pressure manifold 81 to communicate with the fluid discharge conduit 21 and the sump 20. It can be seen that the inner wall 79 initially expands from a minimum diameter entrance portion adjacent the tube 31, to an essentially parallel-walled intermediate portion 82 passing along an intermediate portion of the electrode 17, to a flared portion 83 which flares outwardly to an increasing diameter so as to discharge fluid with essentially minimum turbulence into the low pressure manifold 81. Because a portion of the electrode side wall 60 adjacent the flared portion 83 is of constant cylindrical cross-section, the flared portion 83 of the inner wall 79 of the housing 16 produces a duct of increasing cross-sectional area. This acts as a diffuser to increase pressure of liquid exiting from the arc chamber by converting some of the kinetic energy of the fluid flow to increased pressure.

A cooling water pipe 68 extends from the cooling liquid inlet 38 to the electrode tip 62 to conduct cooling water to cool the tip itself. Water returns from the tip 62 through an annular space 69 between the pipe 68 and an inner wall of the electrode, and then through an electrode cooling water outlet nozzle 71 which extends generally radially outwardly from the electrode sidewall 60 adjacent the wall 66. The nozzle 71 directs cooling water from the electrode 17 into the liquid discharge conduit 21 and into the sump 20. An outer portion of the electrode adjacent the tip has a plurality of axially spaced anti-splash fins 73, each of which extends peripherally around the electrode sidewall 60. Each fin has a shallowly inclined upstream facing wall 75, and a steeply inclined downstream facing wall 76. Thus, it can be seen that the anti-splash fins 73 serve as flow limiting means which are positioned on the electrode side wall so as to reduce chances of reverse flow of liquid relative to the electrode sidewall. This reduces chances of water splashes contacting the electrode, which would otherwise reduce electrode life.

The anode housing 16 as described above is generally functionally similar to the equivalent anode housing in the said U.S. Pat. No. 4,700,102. The present invention provides a simple means to increase efficiency of such prior art apparatus by providing an exhausting means to actively exhaust the liquid and gas leaving the arc chamber through the duct 77. This effectively reduces constriction of the liquid and gas leaving the arc chamber, which permits attainment of higher current densities, and/or extends life of the electrodes. The invention provides an ejector or injector pump structure in which an annular jet nozzle 86 in the inner wall 79 of the housing 16 is disposed to direct a jet of pressurized fluid, such as water, into the liquid and gas discharging from the arc chamber. The jet nozzle extends continuously peripherally around the duct side wall, i.e., the wall 79, and is within a diametrical plane 89. The housing 16 also has an annular high pressure nozzle manifold 91 which extends around the exit duct 77 and, through a smoothly curved passage 92 supplies fluid under pressure to the annular nozzle 86. Thus, it can be seen that the jet nozzle communicates with the high pressure manifold 91 which provides a pressurized fluid source, and is inclined relative to the exit duct 77 to inject the jet of pressurized fluid into the duct which accelerates flow of the liquid and gas through the exit duct. A manifold inlet 93 receives fluid under pressure for the jet from the pump 24 through a conduit 95. It can be seen that the jet nozzle 86 extends essentially continuously and peripherally around the housing inner wall 79 to provide a truncated conical jet of liquid directed inwardly towards the electrode 17 and into the exit duct 77.

The annular exit duct 77 has a radial width 98 and an axial length 99, such that an aspect ratio of width-to-length (i.e. width: length) is in the range of between 1:3 through 1:11. Specifically, one example has an arc chamber of 2.794 centimeters diameter and 15 centimeters length with an electrode maximum diameter of 2.54 centimeters, and the radial width 98 is 0.127 centimeters and the axial length 99 is 1.27 centimeters. The higher aspect ratio of the range is preferred, as this would ensure thorough mixing of liquid from the jet nozzle with the liquid and gas from the arc chamber, thus assisting in cooling the gas prior to dumping through the fluid discharge conduit 21. By cooling the gas prior to dumping into the sump, temperature fluctuations of the gas in the sump are reduced, which reduces pressure fluctuations in the sump and in the low pressure manifold 81 which can aggravate splash-back problems. Preferably, the diametrical plane 89 containing the ejector pump is located as close as possible to the end of the arc chamber adjacent the anode housing which further reduces chances of liquid splash-back problems and essentially eliminates the dependence on gravity for removal of fluid from the arc chamber. Because of the positive or active removal of fluid from the arc chamber, the apparatus can be disposed in almost any inclination or relative position. If necessary, the discharge conduit 25 can be located higher than the arc chamber, see alternative conduit 25, again contrasting with the prior art which required use of gravity to remove fluid from the arc chamber.

OPERATION

Initially, the vortexing flow of liquid and gas is established between the cathode and anode housings, and the fluid from the manifold 91 is pumped through the jet nozzle 86 in the duct 77 to enhance rapid and efficient exhaust of the liquid and gas from the arc chamber. Following procedures described in U.S. Pat. No. 4,027,185, an arc is struck and established between the cathode and anode, the arc being restricted by the liquid wall and stabilized by the gas vortex. The arc provides a high intensity radiation which can be used for many applications requiring high intensity light, heat or other radiation.

The ejector pump raises pressure of the liquid and gas in the arc chamber by a critical amount which is termed the pressure differential. The pressure differential is proportional to pressure in the high pressure manifold 91 which also effects residual pressure in the low pressure manifold 81. For the apparatus shown in FIG. 1, the pressure differential produced by the ejector pump itself is 100 kpas for an arc liquid flow of 0.3 standard liters per second, a gas flow of 1 liter per second and a jet liquid flow of 0.7 liters per second at 600 kpas. The annular jet gap (measured along the duct) is 0.038 centimeters and the jet is 2.54 centimeters in diameter. Pressure of liquid in the annular manifold 91, i.e. the jet supply pressure, can be varied up to 40% of the jet liquid pressure by adjusting fluid flows of a given jet size. Alternatively a different width of the jet gap can be used to vary operating parameters. Residual pressure of gas within the sump 20 is such that the gas, when separated from the liquid, can pass along the gas return line 28 into the gas inlet 30 without requiring an additional increase in pressure from a gas recirculating compressor usually required in the prior art apparatus. Thus, the additional cost and complexity of a gas compressor in the return line is eliminated, which reduces operating costs and gas losses as most of the moving parts have been eliminated.

ALTERNATIVES

While the invention has been described showing water and gas flowing from the inlet or cathode housing 14 to the outlet or anode housing 15, the direction of electrical current can be reversed, or an alternating current can be substituted.

FIG. 2

An alternative embodiment of the invention 101 has an inlet or cathode housing, not shown, which can be essentially identical to the cathode housing 14 in FIG. 1. The alternative embodiment also has a similar arc tube 102 to provide an arc chamber 104 which cooperates with the cathode housing, and has an alternative anode or outlet housing 106.

The housing 106 has a fluid discharge conduit 107, and an alternative electrode 108 which has an electrode side wall 109, an electrode tip 110 and an electrode root portion 111 extending from a mounting which serves as an outer wall 112 of the housing. A plurality of anti-splash fins 113, which are generally similar to the fins 73 of FIG. 1, are provided between the electrode tip 110 and an intermediate portion 115 of the electrode side wall. The housing has an inner wall 117 which has a relatively narrow entrance portion adjacent the arc tube 102, which expands into an essentially parallel-walled, intermediate portion 119 and which then opens into a flared portion 121 which communicates with a low pressure manifold 123 which is generally similar to the low pressure manifold 81 of FIG. 1. Space between the inner wall 117 and the electrode 108 provides an annular fluid exit duct 124 which extends from the arc chamber 104 into the low pressure manifold 123. The manifold 124 receives the liquid and gas exhausted from the arc chamber, which then discharges through the conduit 107 into the sump, not shown.

An electrode cooling water pipe 125 extends from a cooling water inlet 127 to a position adjacent to the electrode tip 110 to discharge water to cool the tip. Water from the electrode tip is returned through an annular passage 130 extending along the outside of the pipe 125 to discharge through an electrode cooling water outlet 132 into the fluid discharge conduit 107.

The above description is generally similar to that of the anode housing 16 of FIG. 1. The alternative anode housing 106 differs by providing an alternative exhausting means, namely an annular jet nozzle 136 on the intermediate portion 115 of the electrode sidewall 109. This contrasts with the outlet housing 16 of FIG. 1, which has an annular jet nozzle on the inner wall 79 of the housing. Thus, the high pressure annular manifold 91 of FIG. 1 is eliminated, and instead an annular supply manifold 138 within the electrode supplies high pressure water to the annular jet nozzle 136. The manifold 138 also receives water from the inlet 127 and thus it can be seen that high pressure water in the water inlet 127 is divided into two separate flow portions, one portion flowing along the cooling water pipe 125 towards the electrode tip 110, and another portion flowing through an opening 135 into the annular high pressure manifold 138 to supply fluid to the annular jet nozzle 136.

Similarly to the FIG. 1 embodiment, the annular nozzle 136 provides an ejector pump having a jet nozzle disposed within a diametrical plane 137 to direct pressurized fluid into the liquid and gas discharging from the arc chamber. The nozzle 136 communicates with the pressurized fluid source in the manifold 138, and the jet nozzle extends essentially continuously peripherally around the electrode side wall to provide a truncated conical jet of liquid directed outwardly from the electrode and into the exit duct.

Figure 2:
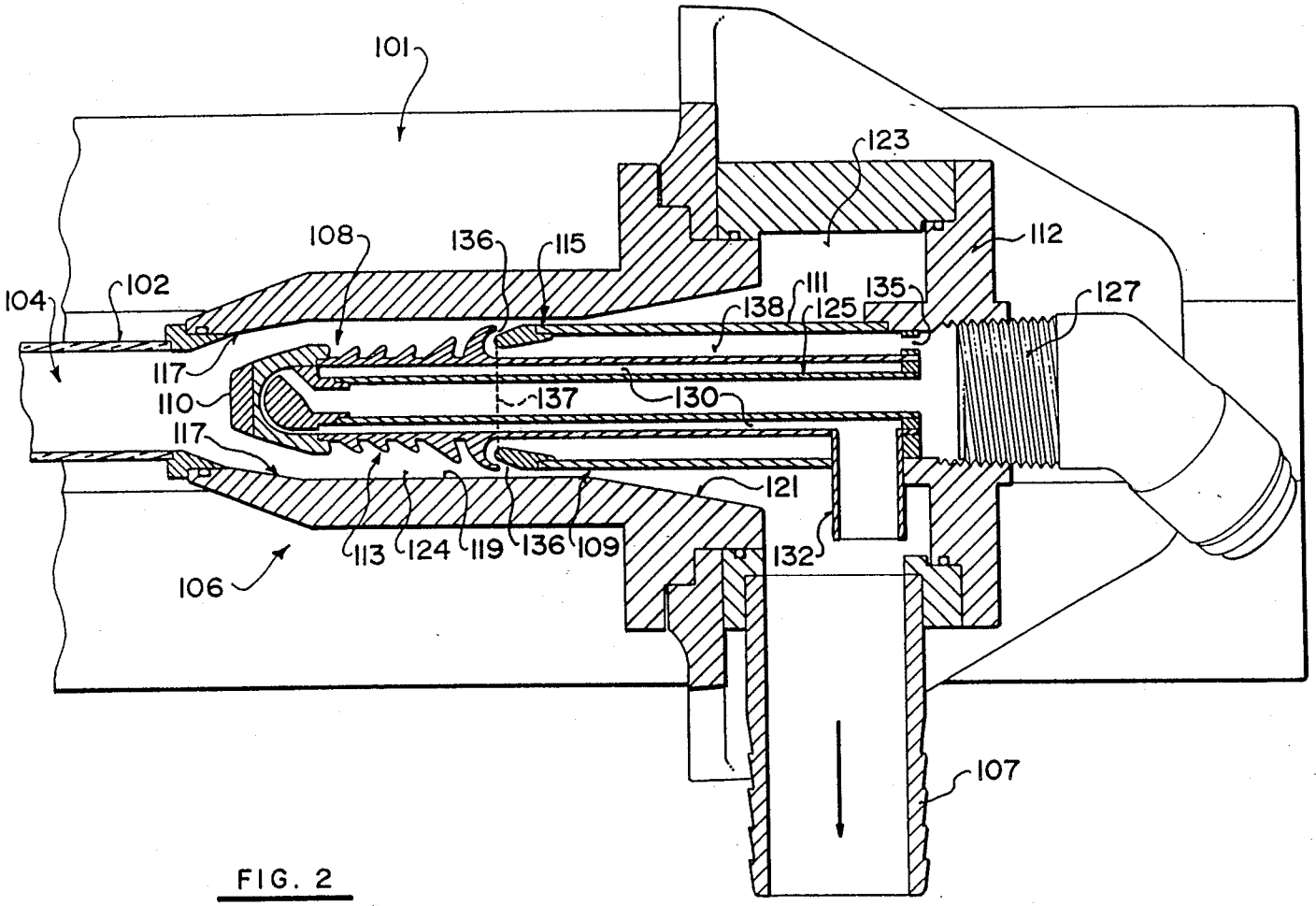
FIG. 2 is a simplified fragmented longitudinal cross-section on a diameter of an alternative exhaust structure adjacent a right-hand portion of the invention, a left-hand portion of the invention which is not illustrated being essentially identical to that of FIG. 1A.

The operation of the alternative embodiment is essentially identical to that of the embodiment in FIG. 1A because in each embodiment the exit duct has a duct wall provided with a jet nozzle. Clearly, at a cost of increased complexity, and possibly improved efficiency, an annular jet nozzle can be provided both on the anode housing inner wall as shown in FIG. 1A, and on the electrode side wall as shown in FIG. 2. It is added that any liquid vapour introduced by pumping liquid, that is the cooling water, is of no consequence as it merely adds to the flow from the arc chamber.

In summary, it can be seen that the method of the invention includes injecting liquid and gas into the arc chamber and generating a vortex motion therein so that the liquid forms a cylindrical liquid wall adjacent the chamber and the gas follows the vortex motion adjacent the cylindrical liquid wall. The method further includes actively exhausting the liquid and gas from the arc chamber by injecting a jet of pressurized fluid into the liquid and gas leaving the arc chamber. Preferably, the jet of pressurized fluid is liquid and is injected through a continuously peripherally extending, inclined jet nozzle disposed within one or both walls of the exit duct extending from the arc chamber to the sump. Both embodiments of the invention permit separation by gravity of the gas and the liquid mixture discharged from the arc chamber, followed by conducting the gas from the exit of the arc chamber to the opposite end of the arc chamber through the gas return line or conduit using only the pressure difference generated by the pressurized fluid in the jet.

We claim:

1. An apparatus for producing a high intensity radiation comprising:

(a) an elongated cylindrical arc chamber, (b) first and second electrode means positioned coaxially within said chamber between which an arc discharge can be established, (c) liquid injecting means for injecting liquid into the arc chamber to produce a vortex motion therein to form a cylindrical liquid wall adjacent the chamber, so as to constrict the arc discharge by cooling an outer periphery of the arc discharge, (d) gas injecting means for injecting gas into the arc chamber to produce a vortex motion therein adjacent the cylindrical liquid wall, the liquid and gas passing through the arc chamber, (e) exhausting means to actively exhaust the liquid and gas from the arc chamber, the exhausting means comprising an exit duct extending from the arc chamber to communicate with a sump means, and an ejector pump having a jet nozzle disposed to direct a jet of pressurized fluid into the exit duct containing the liquid and gas discharged from the arc chamber, the exit duct having a cross-sectional area and length to provide sufficient mixing of the pressurized fluid from the jet nozzle with the liquid and gas leaving the arc chamber to increase pressure of and to impart momentum to the liquid and gas leaving the arc chamber.

2. An apparatus as claimed in claim 1 in which:

(a) the jet nozzle extends essentially continuously peripherally around the duct side wall within a diametrical plane to provide an annular jet nozzle.

3. An apparatus as claimed in claim 1 further comprising:

(a) an exit duct extending from the arc chamber to communicate with a sump means, (b) a return conduit extending between the sump means and the gas injecting means to return gas from the arc chamber under pressure from the sump means to the gas injecting means.

4. An apparatus as claimed in claim 1 further comprising:

(a) first and second electrode housings enclosing the first and second electrode means respectively, each electrode means having an electrode side wall, each electrode housing having a housing inner wall spaced from the electrode side wall to define an annular fluid exit duct therebetween to pass fluid relative to the arc chamber, (b) the jet nozzle being inclined relative to the duct to inject pressurized fluid into the duct.

5. An apparatus as claimed in claim 4 in which:

(a) the jet nozzle extends essentially continuously peripherally around the housing inner wall to provide a truncated conical jet of liquid directed inwardly towards the electrode and into the exit duct.

6. An apparatus as claimed in claim 4 in which:

(a) the jet nozzle extends essentially continuously peripherally around the electrode side wall to provide a truncated conical jet of liquid directed outwardly from the electrode and into the exit duct.

7. An apparatus as claimed in claim 4 in which the annular exit duct has an intermediate portion having a radial width and an axial length, such that an aspect ratio of the width to the length of the duct is in the range of between 1:3 through 1:11.

8. An apparatus as claimed in claim 1 in which:

(a) an electrode means is associated with the exhausting means, and the said electrode means has a body having a plurality of flow limiting means, the flow limiting means being positioned so as to reduce chances of reverse flow of liquid relative to the electrode body as the liquid passes the electrode.

9. An apparatus as claimed in claim 8 in which:

(a) the flow limiting means includes the electrode having at least one anti-splash fin extending therearound.

10. An apparatus as claimed in claim 8 in which:

(a) the flow limiting means includes a plurality of anti-splash fins extending around the electrode, each fin having a shallowly inclined upstream facing wall, and a steeply inclined downstream facing wall.

11. An apparatus as claimed in claim 1 in which the exhausting means comprises:

(a) the exhaust duct having a duct wall, and the jet nozzle smoothly cooperating with the duct wall and communicating with a pressurized fluid source, the nozzle being inclined relative to the duct wall to inject a jet of pressurized fluid into the duct to serve as the ejector pump to impart momentum to the gas and liquid flowing in the exit duct.

12. An apparatus as claimed in claim 7 in which:

(a) the exit duct has a flared portion downstream from the intermediate portion so that a downstream portion of the duct has an increasing cross-sectional area to act as a diffuser to increase pressure.

13. A method of operating an apparatus for producing a high intensity radiation comprising the steps of:

(a) providing first and second electrode means positioned co-axially within an arc chamber, (b) injecting a liquid and a gas into the arc chamber and generating a vortex motion therein so that the liquid forms a cylindrical liquid wall adjacent the chamber, and the gas follows the vortex motion adjacent the cylindrical liquid wall, (c) while maintaining an arc between the electrodes, actively exhausting the liquid and gas from the arc chamber by injecting a jet of pressurized fluid into an exit duct extending from the arc chamber to communicate with a sump means, the jet of pressurized fluid mixing sufficiently with the liquid and gas leaving the arc chamber so as to increase pressure of and impart momentum to the liquid and gas leaving the arc chamber.

14. A method as claimed in claim 13 further characterized by:

(a) injecting the jet of fluid from a nozzle disposed within a wall of the exit duct, the nozzle being inclined into the duct and directed downstream.

15. A method as claimed in claim 13 further characterized by:

(a) injecting the jet of fluid through a continuously peripherally extending jet nozzle located within a wall of an exit duct exhausting the arc chamber.

16. A method as claimed in claim 13 further characterized by:

(a) separating the gas from the gas and liquid mixture discharged from the arc chamber, (b) conducting the gas from the exit of the arc chamber to an opposite end of the arc chamber as a result of a residual pressure difference generated by the jet of the pressurized fluid.

17. A method as claimed in claim 13 further characterized by:

(a) actively exhausting the liquid and gas from the arc chamber by pressurizing the liquid and gas leaving the arc chamber, (b) separating the gas from the gas and liquid discharged from the arc chamber, (c) transferring the gas from an exit of the arc chamber to an opposite end of the arc chamber as a result of a residual pressure increase generated during said exhaustion of the liquid and gas.

18. A method as claimed in claim 13 further characterized by:

(a) injecting the pressurized jet of fluid as a truncated conical jet of liquid directed inwardly towards the liquid and gas leaving the arc chamber.

19. A method as claimed in claim 13 as characterized by:

(a) injecting the pressurized jet of fluid as a truncated conical jet of liquid directed outwardly towards the liquid and gas leaving the arc chamber.

20. A method as claimed in claim 14 further characterized by:

(a) inclining the nozzle inwardly and downstream of the duct, so as to mix fluid from the nozzle smoothly into the liquid and gas discharged from the arc chamber.

* * * * *